US011250801B2

(12) United States Patent
Yang

(10) Patent No.: US 11,250,801 B2
(45) Date of Patent: Feb. 15, 2022

(54) DISPLAY DRIVE METHOD AND DISPLAY DEVICE

(71) Applicant: HKC CORPORATION LIMITED, Guangdong (CN)

(72) Inventor: Yanna Yang, Guangdong (CN)

(73) Assignee: HKC CORPORATION LIMITED, Guangdong (CN)

( * ) Notice: Subject to any disclaimer, the term of this patent is extended or adjusted under 35 U.S.C. 154(b) by 0 days.

(21) Appl. No.: 17/059,262

(22) PCT Filed: Dec. 4, 2019

(86) PCT No.: PCT/CN2019/123079

§ 371 (c)(1),
(2) Date: Nov. 27, 2020

(87) PCT Pub. No.: WO2020/119557

PCT Pub. Date: Jun. 18, 2020

(65) Prior Publication Data

US 2021/0210034 A1 Jul. 8, 2021

(30) Foreign Application Priority Data

Dec. 12, 2018 (CN) ..... 201811522482.1

(51) Int. Cl.
*G09G 3/36* (2006.01)

(52) U.S. Cl.
CPC ..... *G09G 3/3614* (2013.01); *G09G 3/3607* (2013.01); *G09G 3/3648* (2013.01); *G09G 2310/0202* (2013.01); *G09G 2310/0251* (2013.01); *G09G 2320/0233* (2013.01)

(58) Field of Classification Search
CPC combination set(s) only.
See application file for complete search history.

(56) References Cited

U.S. PATENT DOCUMENTS

2007/0229433 A1* 10/2007 Jang ..... G09G 3/3696 345/96
2013/0314397 A1* 11/2013 Tanaka ..... G09G 3/3648 345/215
2015/0310815 A1* 10/2015 Deng ..... G09G 3/3614 345/209

FOREIGN PATENT DOCUMENTS

CN 101399020 A 4/2009
CN 102074216 A 5/2011
CN 102347013 A 2/2012
CN 103985365 A 8/2014
(Continued)

OTHER PUBLICATIONS

First Office Action in counterpart Chinese Application No. 201811522482.1, dated Jan. 2, 2020.
(Continued)

*Primary Examiner* — Van N Chow

(57) ABSTRACT

Disclosed is a display drive method and a display device, where the display drive method includes the following operations: in response to a scan signal on a scan line connected to a pixel being converted from an off-level to a first on-level at a first time point, in a determination that a data signal on a data line connected to the pixel is inverted from a first polarity to a second polarity, controlling the scan signal to be at a second on-level in a pre-charging duration before the first time point to pre-charge the pixel by the data signal, wherein the data signal is in the second polarity in the pre-charging duration.

13 Claims, 4 Drawing Sheets

(56) References Cited

FOREIGN PATENT DOCUMENTS

| | | | |
|---|---|---|---|
| CN | 104916265 | A | 9/2015 |
| CN | 105976747 | A | 9/2016 |
| CN | 109360536 | A | 2/2019 |
| KR | 101096692 | B1 | 12/2011 |

OTHER PUBLICATIONS

The Second Office Action in counterpart Chinese Application No. 201811522482.1, dated Jun. 19, 2020.
The Third Office Action in counterpart Chinese Application No. 201811522482.1, dated Oct. 12, 2020.
International Search Report in corresponding PCT Application No. PCT/CN2019/123079, dated Feb. 26, 2020.
Written Opinion of the International Searching Authority in corresponding PCT Application No. PCT/CN2019/123079, dated Feb. 26, 2020.

* cited by examiner

DISPLAY DRIVE METHOD AND DISPLAY DEVICE

CROSS-REFERENCE TO RELATED APPLICATIONS

This application is the National Stage of International Application with No. PCT/CN2019/123079, filed on Dec. 4, 2019, which claims the benefit of Chinese Patent application with No. 201811522482.1, filed on Dec. 12, 2018 and entitled "Display drive method and display device", the entirety of which is hereby incorporated herein by reference.

FIELD

This application relates to the field of display technology, and in particular to a display drive method and a display device.

BACKGROUND

The statements here only provide background information related to this application, and do not necessarily constitute prior art. Display panel is an important part of the display device, which includes a plurality of pixels, and each pixel displays a certain gray scale brightness under the driving action of a switch device and the like to form a display image. Generally, the display is driven in a progressive scan mode. Under the control of the scan signal on the scan line, pixels in the corresponding scan lines are charged by the data signal on the data lines to display a certain grayscale brightness. In order to improve the display effect of the display device, in the process of driving the display, the polarity of the data signal is usually inverted in a certain manner.

In a display device, the data signal will be inverted every certain number of scan lines. During the process of at least part of the scan lines being turned on, the polarity of the data signal is inverted from negative to positive, or from positive to negative, causing the pixels in these scan lines to have a longer inversion delay when being charged, and the actual charging time of the pixels in different scan lines is different, making the charging effect in the entire display panel uneven. Correspondingly, when the display screen is of uniform grayscale brightness, the actual display effect is also uneven, which is usually manifested as the presence of faint bright and dark lines in the same direction as the extension of the scan lines on the display screen.

SUMMARY

The main object of this application is to provide a display drive method, which realizes the optimization of display uniformity and improves the display effect.

In order to achieve the above objective, the display drive method provided in this application includes the following operations:

in response to a scan signal on a scan line connected to a pixel being converted from an off-level to a first on-level at a first time point, in a determination that a data signal on a data line connected to the pixel is inverted from a first polarity to a second polarity, controlling the scan signal to be at a second on-level in a pre-charging duration before the first time point to pre-charge the pixel by the data signal, where the data signal is in the second polarity in the pre-charging duration.

In order to achieve the above objective, this application further provides a display drive method including the following operations:

in response to a scan signal on a scan line connected to a pixel being converted from an off-level to a first on-level at a first time point, in a determination that a data signal on a data line connected to the pixel is inverted from a first polarity to a second polarity, controlling the scan signal to be at a second on-level in a pre-charging duration before the first time point to pre-charge the pixel by the data signal, where the data signal is in the second polarity in the pre-charging duration, and an absolute value of the first on-level is greater than or equal to an absolute value of the second on-level.

In order to achieve the above objective, this application further provides a display device including a display panel and a display drive component, and the display panel includes a plurality of pixels arranged in an array, a plurality of scan lines, and a plurality of data lines. The display drive component is connected to the plurality of scan lines and the plurality of data lines, in response to a scan signal on a scan line connected to a pixel being converted from an off-level to a first on-level at a first time point, in a determination that a data signal on a data line connected to the pixel is inverted from a first polarity to a second polarity, controlling, by the display drive component, the scan signal to be at a second on-level in a pre-charging duration before the first time point to pre-charge the pixel by the data signal, where the data signal is in the second polarity in the pre-charging duration.

In the technical solution of this application, the display drive method includes the following operations: in response to a scan signal on a scan line connected to a pixel being converted from an off-level to a first on-level at a first time point, in a determination that a data signal on a data line connected to the pixel is inverted from a first polarity to a second polarity, controlling the scan signal to be at a second on-level in a pre-charging duration before the first time point to pre-charge the pixel by the data signal, where the data signal is in the second polarity in the pre-charging duration. According to the polarity inversion of the data signal on the data line when the pixel is turned on and charged, the pixel is pre-charged to avoid the pixel from being undercharged due to the inversion delay, which may cause the display grayscale to deviate. When the pixel is turned on and charged under the control of the scan signal, the data signal is inverted from the first polarity to the second polarity, before the data signal is inverted from the first polarity to the second polarity, a duration of the data signal in the second polarity is selected, and the scan signal is controlled to be at the second on-level to achieve pre-charging of the pixel, thereby avoiding the generation of bright and dark lines in the extension direction of the scan lines, improving the uniformity of the display, and thereby improving the display effect.

BRIEF DESCRIPTION OF THE DRAWINGS

In order to more clearly describe the technical solutions in the embodiments of this application, the following will briefly introduce the drawings that need to be used in the description of the embodiments. Obviously, the drawings in the following description are only some embodiments of this application. For those of ordinary skill in the art, without creative work, other drawings can be obtained according to the structures shown in these drawings.

Figure 1:
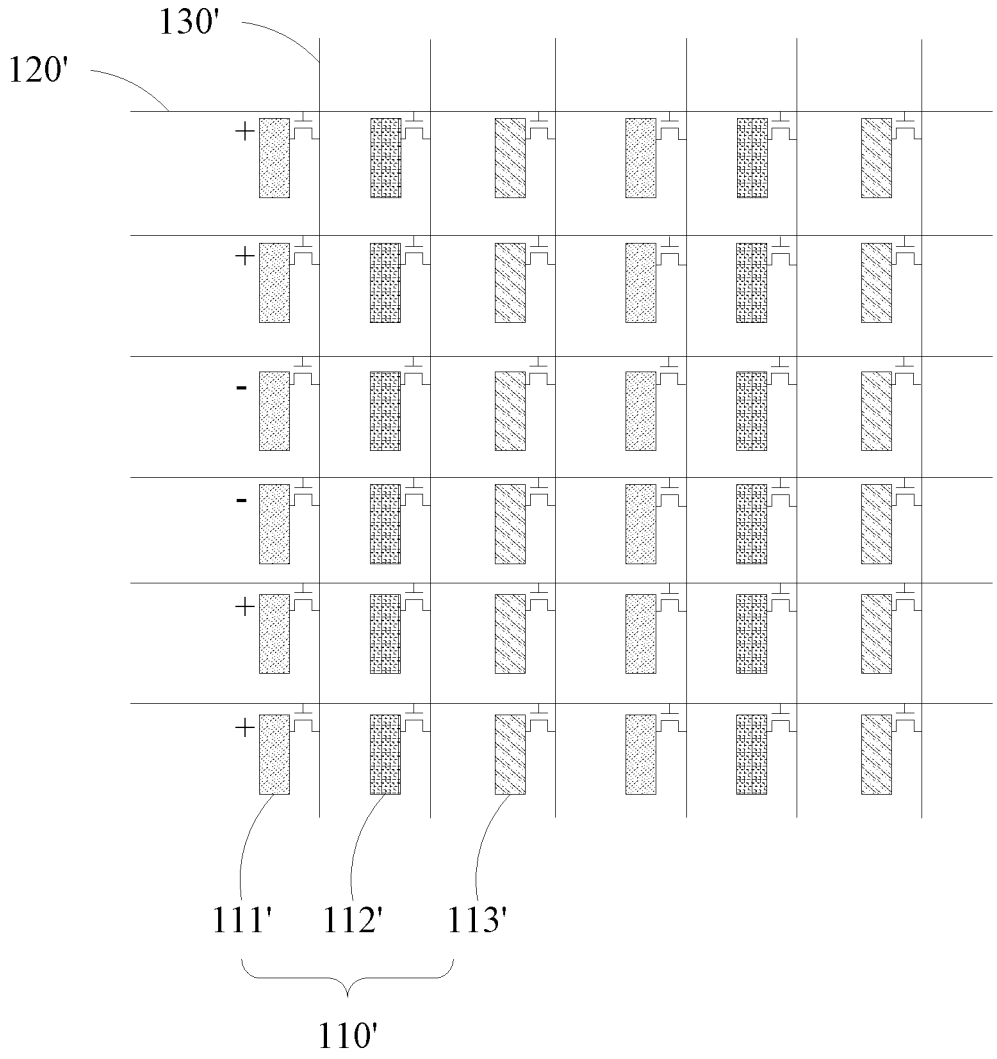
FIG. 1 is a schematic structural diagram of a display panel of a display device according to an example.

The realization, functional characteristics, and advantages of the purpose of this application will be further described in conjunction with the embodiments and with reference to the accompanying drawings.

DETAILED DESCRIPTION OF THE EMBODIMENTS

The technical solutions in the embodiments of this application will be described clearly and completely in conjunction with the drawings in the embodiments of this application. Obviously, the described embodiments are only a part of the embodiments of this application, but not all the embodiments. Based on the embodiments in this application, all other embodiments obtained by those of ordinary skill in the art without creative work shall fall within the protection scope of this application.

It should be noted that if there is a directional indication (such as up, down, left, right, front, back . . . ) in the embodiment of this application, the directional indication is only used to explain the relative positional relationship, movement conditions, etc. among the components in a specific posture (as shown in the drawings), if the specific posture changes, the directional indicator also changes accordingly.

In addition, if there are descriptions related to "first", "second", etc. in the embodiments of this application, the descriptions of "first", "second", etc. are for descriptive purposes only, and cannot be understood as indicating or implying their relative importance or implicitly indicating the number of indicated technical features. Thus, the features defined as "first" and "second" may include at least one of the features either explicitly or implicitly. In addition, the meaning of "and/or" in the full text means that it includes three parallel schemes. Taking "A and/or B" as an example, it includes scheme A, scheme B, and a scheme in which both A and B meet. In addition, the technical solutions between the various embodiments can be combined with each other, but they must be based on the ability of those skilled in the art to realize. When the combination of technical solutions conflicts with each other or cannot be realized, it should be considered that the combination of such technical solutions does not exist, nor within the scope of protection required by this application.

Figure 2:
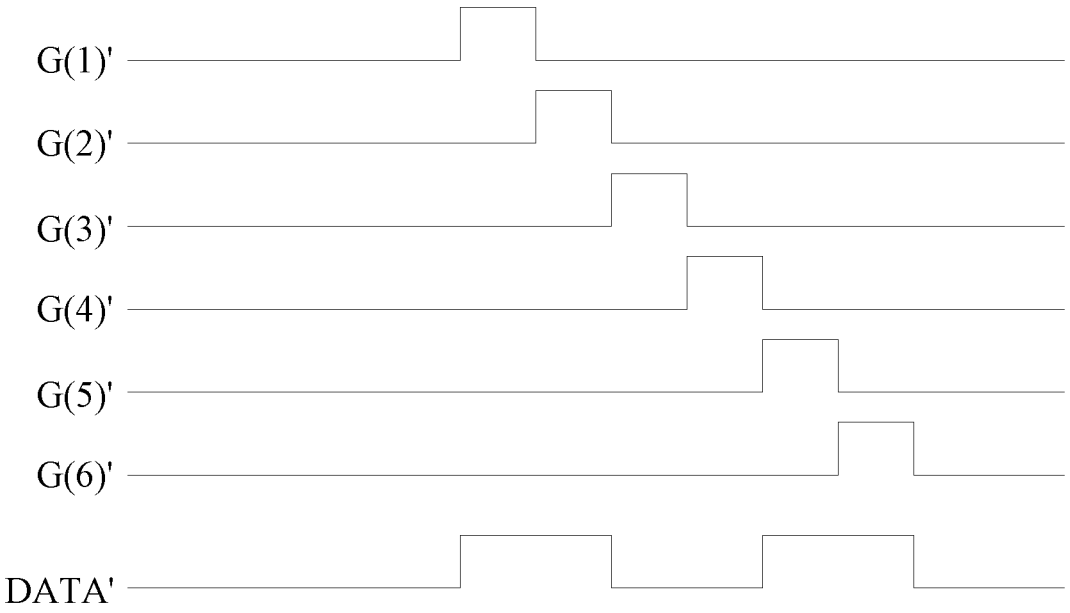
FIG. 2 is a schematic timing diagram of part of scan signals and data signals of the display device according to an example.

In the following text, a liquid crystal display panel will be taken as an example to describe the technical solution of this application in detail. In an example, as shown in FIGS. 1 and 2, the display panel of the display device includes a plurality of pixels, a plurality of scan lines 120' and a plurality of data lines 130', where the plurality of pixels are usually arranged in a rectangular array, the plurality of scan lines 120' are extended along a lateral direction of the display panel, and the plurality of data lines 130' are extended along a longitudinal direction of the display panel. In this example, TFTs (Thin Film Transistors) in pixels in a same row are connected to a same scan line, and TFTs in pixels in a same column are connected to a same data line, and a pixel electrode of each pixel is connected to a TFT of the pixel in one-to-one correspondence. Under the action of the scan signal on the scan line 120', the TFTs control the data lines 130' to charge the corresponding pixel electrodes, thereby forming a voltage between the pixel electrode and the common electrode of the pixel capacitor in the pixel to control the deflection angle of the liquid crystal in the pixel. Generally, a display panel includes three types of pixels: a red pixel 111', a green pixel 112', and a blue pixel 113'. At least one red pixel 111', one green pixel 112', and one blue pixel 113' form a pixel group 110'. Thus, a colorful picture is displayed according to the principle of spatial color mixing. In order to maintain the pixel level on the pixel electrode to ensure the display effect, a storage capacitor and the like may also be provided in the pixel. Generally, the display panel is driven in a progressive scan manner. Assuming that the TFTs shown in FIG. 1 are all NMOS TFTs (N Metal Oxide Semiconductor TFTs), then, when the scan signal on the scan line 120' is at a high level, the corresponding NMOS TFTs are turned on, the source electrode and the drain electrode are connected, so that the data signal on the data lines 130' charges the pixel electrode. As shown in FIG. 2, the scan signals on the scan lines 120' of each row are converted to a high level state one by one, and return to a low level state after a certain charging duration, so as to achieve progressive scan driving. While a polarity of the data signal on the data lines 130' is inverted every certain duration. Here, after every two scan lines are charged, the polarity of the data signal is inverted once. Then, when odd-numbered scan signals (G(1)', G(3)', G(5)', . . . ) control odd-numbered rows of pixels to turn on, the polarity of the data signal DATA' will be inverted with a long inversion delay, so that the odd-numbered rows of pixels may be insufficiently charged. When even-numbered scan signals (G(2)', G(4)', G(6)', . . . ) control even-numbered rows of pixels to turn on, the polarity of the data signal DATA' will not be inverted, so as to achieve sufficient charging of pixels in even rows. The above-mentioned difference in charging conditions between pixels in different rows will result in uneven display.

This application provides a display drive method, which may improve the uniformity of the display and the display effect by pre-charging pixels with a long inversion delay during charging.

In an embodiment of this application, the display drive method includes the following operations:

Step S100, in response to a scan signal on a scan line connected to a pixel being converted from an off-level to a first on-level at a first time point, in a determination that a data signal on a data line connected to the pixel is inverted from a first polarity to a second polarity, controlling the scan signal to be at a second on-level in a pre-charging duration before the first time point to pre-charge the pixel by the data signal, where the data signal is in the second polarity in the pre-charging duration.

When the scan signal is at the off-level, the TFT in the pixel connected to the scan line is in the off state, that is, the source electrode and the drain electrode are disconnected, so as to avoid the data signal on the data line from charging the pixel and causing interference. When the scan signal is at the first on-level, the TFT in the pixel connected to the scan line is in a conduction state, that is, the source electrode and the drain electrode are conductive, and the data signal on the data line charges the pixel electrode of the pixel through the TFT to control the grayscale brightness. When the scan signal is at the second on-level, the TFT in the pixel connected to the scan line is in the conduction state, that is, the source electrode and the drain electrode are conductive, and the data signal on the data line pre-charges the pixel electrode of the pixel through the TFT. Generally, the TFT in the display panel is an NMOS TFT. Correspondingly, the first on-level and the second on-level are high, and the off-level is low. When the scan signal on the scan line connected to the pixel is converted from the off-level to the first on-level, that is, when the TFT in the pixel is converted from the off state to the on state, the data signal on the data line will charge the pixel. If the data signal on the data line connected to the pixel is inverted from the first polarity to the second polarity at this time, that is, the data signal is inverted from positive polarity to negative polarity, or from negative polarity to positive polarity, due to the influence of the drive capability of the display device, there will be a large inversion delay. In this case, in order to compensate for insufficient charging, before the data signal is inverted from the first polarity to the second polarity, when the data signal is in the second polarity, the scan signal is controlled to be at the second on-level to realize the pre-charging of the pixel to ensure the charging effect of the pixel. Where, the polarity inversion of the data signal is performed at regular intervals, and the polarity inversion duration may be equivalent to a turn-on duration of the scan signal at the first on-level each time, or greater than the turn-on duration of the scan signal. For different data lines in the display panel, an initial polarity of the data signal on each data line may be set according to requirements, so as to realize drive in different modes such as dot inversion and row inversion in the display panel.

In this embodiment, the display drive method includes the following operations: in response to a scan signal on a scan line connected to a pixel being converted from an off-level to a first on-level at a first time point, in a determination that a data signal on a data line connected to the pixel is inverted from a first polarity to a second polarity, before the data signal is inverted from the first polarity to the second polarity, controlling the scan signal to be at a second on-level in a pre-charging duration before the first time point to pre-charge the pixel by the data signal, where the data signal is in the second polarity in the pre-charging duration. According to the polarity inversion of the data signal on the data line when the pixel is turned on and charged, the pixel is pre-charged to avoid the pixel from being undercharged due to the inversion delay, which may cause the display grayscale to deviate. If when the pixel is turned on and charged under the control of the scan signal, the data signal is inverted from the first polarity to the second polarity, before the data signal is inverted from the first polarity to the second polarity, a duration of the data signal at the second polarity is selected, and the scan signal is controlled to be at the second on-level to achieve pre-charging of the pixel, thereby avoiding the generation of bright and dark lines in the extension direction of the scan lines, improving the uniformity of the display, and thereby improving the display effect.

Optionally, the display drive method includes the following operations:

Step S200, in one frame, in response to the scan signal on the scan line connected to the pixel being converted from the off-level to the first on-level at a second time point, in a determination that a polarity of the data signal on the data line connected to the pixel does not change, controlling the scan signal to be at the off-level before the second time point.

Normally, the display panel is driven frame by frame, and in each frame, the drive is performed line by line. In one frame, when all the pixels have been driven, return to the initial state to start the next frame's drive. When the scan signal on the scan line connected to the pixel is converted from the off-level to the first on-level, that is, when the pixel is converted from the off state to the on state, if the polarity of the data signal on the data line connected to the pixel remains unchanged, it indicates that the pixel does not have a long inversion delay during the charging process, that is, the charging effect may be well guaranteed. In order to avoid that when the TFT is turned on in advance, the data signals corresponding to other pixels interfere with the grayscale brightness of the pixel, in one frame, before the scan signal is converted to the first on-level, the clock keeps the scan signal at the off-level, so as to optimize the display effect.

Optionally, the display drive method includes the following operations:

Step S300, in a determination that the scan signal is at the first on-level, charging the pixel by the data signal; and where, an absolute value of the first on-level is greater than or equal to an absolute value of the second on-level.

After the scan signal is converted to the first on-level, the data signal connected to the data line of the pixel will charge the pixel, so that the pixel displays a certain grayscale brightness. Considering that the first on-level corresponds to a level on a gate electrode of the TFT when the pixel is charged, the second on-level corresponds to a level on the gate electrode of the TFT when the pixel is pre-charged, and the magnitude of the level applied on the gate electrode of the TFT will affect the turn-on degree of the TFT, the state of the pixel being charged or pre-charged may be controlled by adjusting the magnitude of the first on-level and the second on-level. When the pixel is pre-charged, in order to avoid that the TFT is fully turned on and the charging effect is too strong, and data level corresponding to other pixels interferes with the grayscale brightness of the pixel, the second on-level with an absolute value smaller than an absolute value of the first on-level may be selected to partially turn on the TFT to pre-charge the pixel. Or, when the inversion delay of the pixel being charged is large, in order to ensure the charging effect of the pixel, the second on-level with an absolute value being equal to an absolute value of the first on-level may be selected. In particular, when the TFT is an NMOS TFT, the first on-level and the second on-level are both positive, that is, the first on-level is greater than or equal to the second on-level.

Optionally, in one frame, a pre-charging duration of the pixel is equivalent to a charging duration of the pixel.

In order to facilitate the generation of scan signal capable of pre-charging the pixel, and at the same time to avoid unnecessary fluctuations or interferences caused by changes in the data signal on the data line during the pre-charging process of the pixel, the pre-charging duration of the pixel at each time is equivalent to the charging duration of the pixel at each time, that is, a single duration of the first on-level and a single duration of the second on-level are the same, so as to improve the drive effect and reduce the drive cost.

Optionally, in one frame, after the pixel is pre-charged, a number of times the data signal is inverted from the second polarity to the first polarity is at most one.

In order to prevent the pixel from being pre-charged prematurely and disturbing the display screen, or the effect of the pixel being pre-charged prematurely decays over time and causing insufficient charging, in one frame, after the pixel is pre-charged, a number of times the data signal is inverted from the second polarity to the first polarity is at most one. That is, before charging the pixel this time, the nearest neighbor duration in which the polarity of the data signal is consistent with the polarity of the data signal during the current charging is selected to pre-charge the pixel, thereby improving the pre-charging effect.

Optionally, in one frame, a polarity inversion period of the data signal is an integer multiple of a duration of the scan signal at the first on-level.

The polarity inversion period of the data signal is set to be an integer multiple of the duration of the scan signal at the first on-level, that is, the polarity inversion period of the data signal is an integer multiple of the on-duration of the scan signal, so as to control the scan signal reaches the second on-level at a proper pre-charging duration, which avoids the timing mismatch between the data signal and the scan signal, which causes the pre-charging duration to be reselected each time, thereby reducing the drive cost.

Optionally, in one frame, a polarity inversion period of the data signal is twice a duration of the scan signal at the first on-level; and the scan signal on every other scan line has the second on-level.

When the polarity inversion period of the data signal is set to be twice the duration of the scan signal at the first on-level, the polarity of the data signal will be inverted once every two scan lines to avoid polarity bias in the display panel, thereby improving the display effect. Correspondingly, the scan signal on every other scan line will change, that is, the scan signal on every other scan line has the second on-level to compensate for insufficient charging caused by the inversion delay in some pixels.

Figure 3:
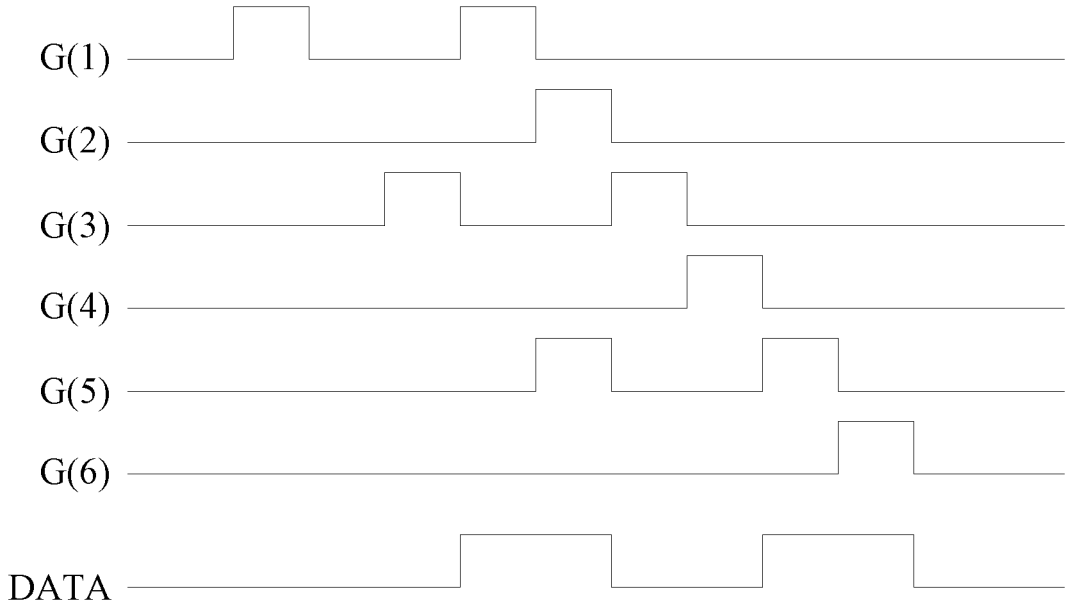
FIG. 3 is a schematic timing diagram of part of scan signals and data signals of a display drive method according to a specific embodiment of this application.

In a specific embodiment, as shown in FIG. 3, it is assumed that the pixels on the same row in the display panel are connected to a same scan line, and the pixels on the same column are connected to a same data line, an on-duration of the scan signal is T, and a polarity inversion period of the data signal is 2T. Then, the scan signals of adjacent rows have different waveforms. For odd-numbered scan signals (G(1), G(3), G(5), . . . ), when the odd-numbered rows of pixels are controlled to be turned on, the polarity of the data signal DATA will be inverted, resulting in a longer inversion delay, and the corresponding pixel row is often insufficiently charged. Therefore, at the moment 3T before the scan signal is converted from the off-level to the first on-level, the scan signal is converted from the off-level to the second on-level, the duration of the second on-level is T, and the pixel is pre-charged. For even-numbered scan signals (G(2), G(4), G(6), . . . ), when the even-numbered row of pixels are controlled to be turned on, the polarity of the data signal DATA is not inverted, and the corresponding pixel row is fully charged, so the even-numbered scan signal has basically the same waveform as the even-numbered scan signal in the example, and the second on-level may not be set.

Figure 4:
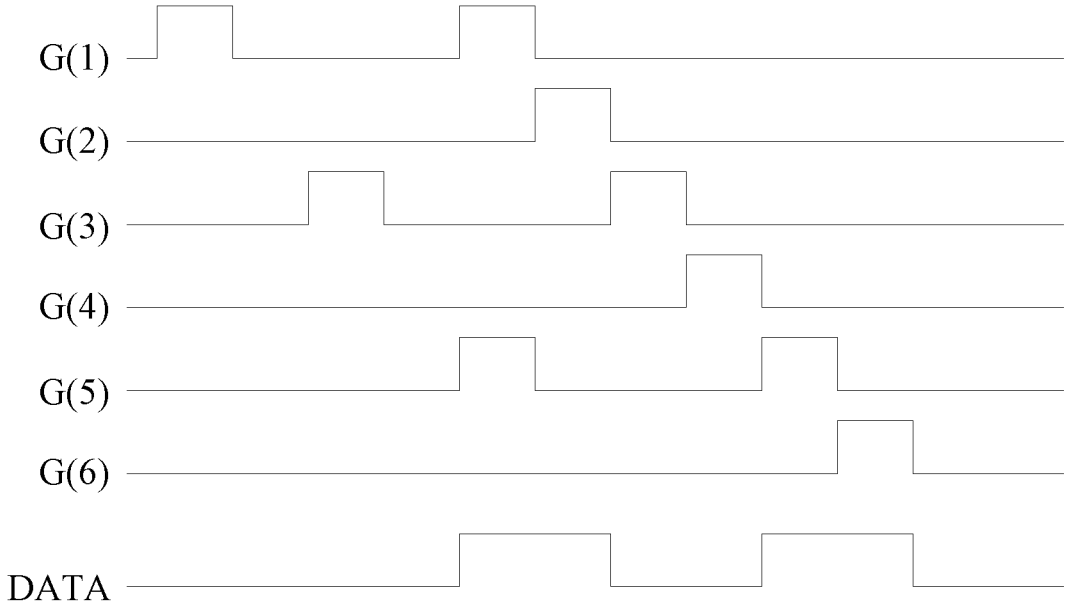
FIG. 4 is a schematic timing diagram of part of scan signals and data signals of the display drive method according to another specific embodiment of this application.

In another specific embodiment, as shown in FIG. 4, it is assumed that the pixels on the same row in the display panel are connected to a same scan line, and the pixels on the same column are connected to a same data line, an on-duration of the scan signal is T, and a polarity inversion period of the data signal is 2T. The scan signals of adjacent rows have different waveforms. For odd-numbered scan signals (G(1), G(3), G(5), . . . ), when the odd-numbered rows of pixels are controlled to be turned on, the polarity of the data signal DATA will be inverted, resulting in a longer inversion delay, and the corresponding pixel row is often insufficiently charged. Therefore, at the moment 4T before the scan signal is converted from the off-level to the first on-level, the scan signal is converted from the off-level to the second on-level, the duration of the second on-level is T, and the pixel is pre-charged. For even-numbered scan signals (G(2), G(4), G(6), . . . ), when the even-numbered row of pixels are controlled to be turned on, the polarity of the data signal DATA is not inverted, and the corresponding pixel row is fully charged, so the even-numbered scan signal has basically the same waveform as the even-numbered scan signal in the example, and the second on-level may not be set.

Figure 5:
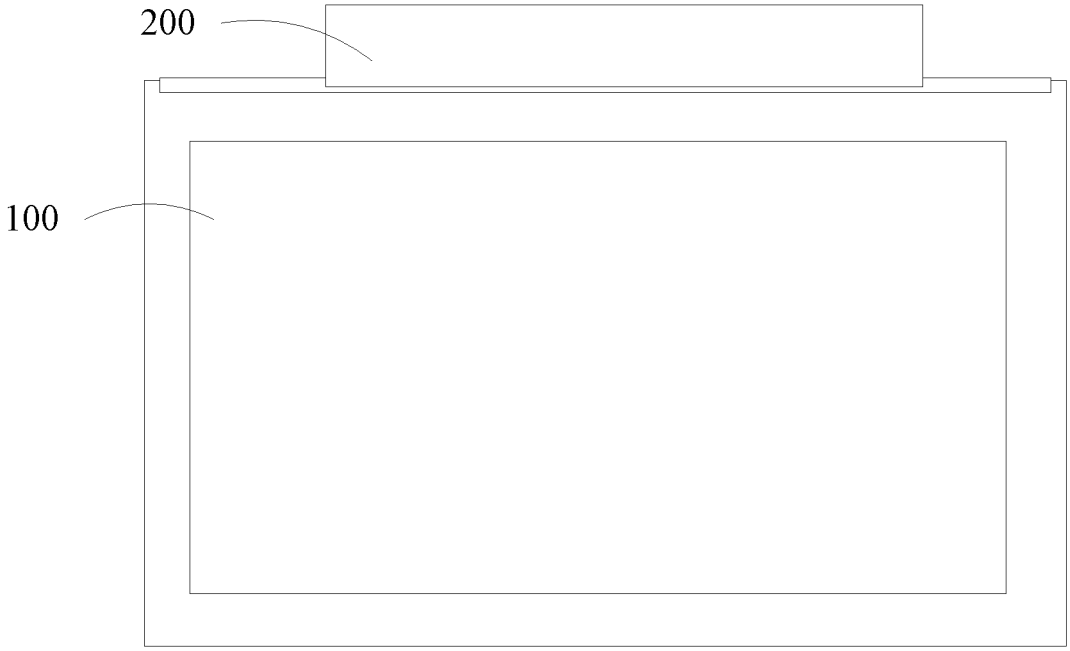
FIG. 5 is a schematic structural diagram of the display device according to an embodiment of this application.
Figure 6:
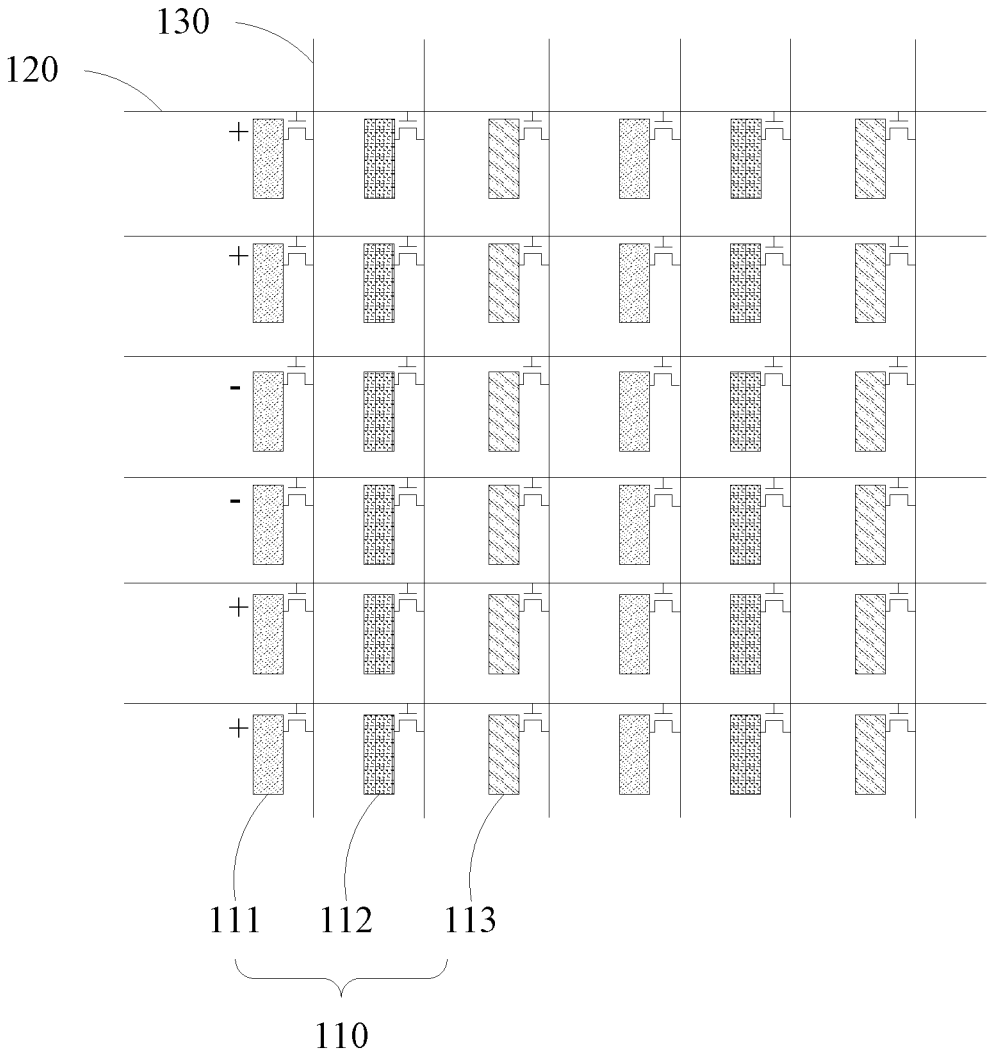
FIG. 6 is a schematic structural diagram of the display panel in FIG. 5.

This application further provides a display device, as shown in FIGS. 5 and 6, the display device includes a display panel 100 and a display drive component 200. The display panel 100 includes a plurality of pixels arranged in an array, a plurality of scan lines 120, and a plurality of data lines 130. The display drive component 200 is connected to the plurality of scan lines 120 and the plurality of data lines 130. In response to a scan signal on a scan line connected to a pixel being converted from an off-level to a first on-level at a first time point, in a determination that a data signal on a data line connected to the pixel is inverted from a first polarity to a second polarity, controlling, by the display drive component, the scan signal to be at a second on-level in a pre-charging duration before the first time point to pre-charge the pixel by the data signal, where the data signal is in the second polarity in the pre-charging duration.

When the scan signal is at the off-level, the TFT in the pixel connected to the scan line 120 is in the off state, that is, the source electrode and the drain electrode are disconnected, so as to avoid the data signal on the data line 130 from charging the pixel and causing interference. When the scan signal is at the first on-level, the TFT in the pixel connected to the scan line 120 is in a conduction state, that is, the source electrode and the drain electrode are conductive, and the data signal on the data line 130 charges the pixel electrode of the pixel through the TFT to control the grayscale brightness. When the scan signal is at the second on-level, the TFT in the pixel connected to the scan line 120 is in the conduction state, that is, the source electrode and the drain electrode are conductive, and the data signal on the data line 130 pre-charges the pixel electrode of the pixel through the TFT. Generally, the TFT in the display panel is an NMOS TFT. Correspondingly, the first on-level and the second on-level are high, and the off-level is low. When the scan signal on the scan line 120 connected to the pixel is converted from the off-level to the first on-level, that is, when the TFT in the pixel is converted from the off state to the on state, the data signal on the data line 130 will charge the pixel. If the data signal on the data line 130 connected to the pixel is inverted from the first polarity to the second polarity at this time, that is, the data signal is inverted from positive polarity to negative polarity, or from negative polarity to positive polarity, due to the influence of the drive capability of the display device, there will be a large inversion delay. In this case, in order to compensate for insufficient charging, before the data signal is inverted from the first polarity to the second polarity, when the data signal is in the second polarity, the scan signal is controlled to be at the second on-level to realize the pre-charging of the pixel to ensure the charging effect of the pixel. Where, the polarity inversion of the data signal is performed at regular intervals, and the polarity inversion duration may be equivalent to a turn-on duration of the scan signal at the first on-level each time, or greater than the turn-on duration of the scan signal. For different data lines 130 in the display panel, an initial polarity of the data signal on each data line 130 may be set according to requirements, so as to realize driving in different modes such as dot inversion and row inversion in the display panel.

Optionally, in one frame, in response to the scan signal on the scan line 120 connected to the pixel being converted from the off-level to the first on-level at a second time point, in a determination that a polarity of the data signal on the data line 130 connected to the pixel does not change, controlling, by the display drive component, the scan signal to be at the off-level before the second time point.

Normally, the display panel is driven frame by frame, and in each frame, the driving is performed line by line. In one frame, when all the pixels have been driven, return to the initial state to start the next frame's drive. When the scan signal on the scan line 120 connected to the pixel is converted from the off-level to the first on-level, that is, when the pixel is converted from the off state to the on state, if the polarity of the data signal on the data line 130 connected to the pixel remains unchanged, it indicates that the pixel does not have a long inversion delay during the charging process, that is, the charging effect may be well guaranteed. In order to avoid that when the TFT is turned on in advance, the data signals corresponding to other pixels interfere with the grayscale brightness of the pixel, in one frame, before the scan signal is converted to the first on-level, the clock keeps the scan signal at the off-level, so as to optimize the display effect.

Optionally, as shown in FIG. 6, pixels in the same row are connected to a same scan line 120, and pixels in different rows are connected to different scan lines 120. Pixels in the same column are connected to a same data line 130, and pixels in different columns are connected to different data lines 130. In one frame, a polarity inversion period of the data signal is twice a duration of the scan signal at the first on-level; and the scan signal on every other row of scan line has the second on-level.

Under the action of the scan signal on the scan line 120, the TFTs control the data lines 130 to charge the corresponding row of pixel electrodes, thereby forming a voltage between the pixel electrode and the common electrode of the pixel capacitor in the pixel to control the deflection angle of the liquid crystal in the pixel. The display panel shown in FIG. 6 includes three types of pixels: a red pixel 111, a green pixel 112, and a blue pixel 113. One red pixel 111, one green pixel 112, and one blue pixel 113 form a pixel group 110. Thus, a colorful picture is displayed according to the principle of spatial color mixing. The polarity inversion period of the data signal is set to be an integer multiple of the duration of the scan signal at the first on-level, that is, the polarity inversion period of the data signal is an integer multiple of the on-duration of the scan signal, so as to control the scan signal reaches the second on-level at a proper pre-charging duration, which avoids the timing mismatch between the data signal and the scan signal, which causes the pre-charging duration to be reselected each time, thereby reducing the drive cost. Specifically, when the polarity inversion period of the data signal is set to be twice the duration of the scan signal at the first on-level, the polarity of the data signal will be inverted once every two scan lines to avoid polarity bias in the display panel, thereby improving the display effect. Correspondingly, the scan signal on every other scan line 120 will change, that is, the scan signal on every other scan line 120 has the second on-level to compensate for insufficient charging caused by the inversion delay in some pixels.

In a specific embodiment, as shown in FIG. 3, it is assumed that an on-duration of the scan signal is T, and a polarity inversion period of the data signal is 2T. Then, the scan signals of adjacent rows have different waveforms. For odd-numbered scan signals (G(1), G(3), G(5), . . . ), when the odd-numbered rows of pixels are controlled to be turned on, the polarity of the data signal DATA will be inverted, resulting in a longer inversion delay, and the corresponding pixel row is often insufficiently charged. Therefore, at the moment 3T before the scan signal is converted from the off-level to the first on-level, the scan signal is converted from the off-level to the second on-level, the duration of the second on-level is T, and the pixel is pre-charged. For even-numbered scan signals (G(2), G(4), G(6), . . . ), when the even-numbered row of pixels are controlled to be turned on, the polarity of the data signal DATA is not inverted, and the corresponding pixel row is fully charged, so the even-numbered scan signal has basically the same waveform as the even-numbered scan signal in the example, and the second on-level may not be set.

In another specific embodiment, as shown in FIG. 4, it is assumed that an on-duration of the scan signal is T, and a polarity inversion period of the data signal is 2T. The scan signals of adjacent rows have different waveforms. For odd-numbered scan signals (G(1), G(3), G(5), . . . ), when the odd-numbered rows of pixels are controlled to be turned on, the polarity of the data signal DATA will be inverted, resulting in a longer inversion delay, and the corresponding pixel row is often insufficiently charged. Therefore, at the moment 4T before the scan signal is converted from the off-level to the first on-level, the scan signal is converted from the off-level to the second on-level, the duration of the second on-level is T, and the pixel is pre-charged. For even-numbered scan signals (G(2), G(4), G(6), . . . ), when the even-numbered row of pixels are controlled to be turned on, the polarity of the data signal DATA is not inverted, and the corresponding pixel row is fully charged, so the even-numbered scan signal has basically the same waveform as the even-numbered scan signal in the example, and the second on-level may not be set.

The above are only the optional embodiments of this application, and therefore do not limit the patent scope of this application. Under the conception of this application, any equivalent structural transformation made by using the content of the description and drawings of this application, or direct/indirect application in other related technical fields are all included in the patent protection scope of this application.

What is claimed is:

1. A display drive method, comprising the following operations:

in response to a scan signal on a scan line connected to a pixel being converted from an off-level to a first on-level at a first time point, in a determination that a data signal on a data line connected to the pixel is inverted from a first polarity to a second polarity, controlling the scan signal to be at a second on-level in a pre-charging duration before the first time point to pre-charge the pixel by the data signal, wherein the data signal is in the second polarity in the pre-charging duration; and in one frame, in response to the scan signal on the scan line connected to the pixel being converted from the off-level to the first on-level at a second time point, in a determination that a polarity of the data signal on the data line connected to the pixel does not change, controlling the scan signal to be at the off-level before the second time point;

wherein in one frame, a polarity inversion period of the data signal is twice a duration of the scan signal at the first on-level; and the scan signal on every other scan line has the second on-level, and one of two adjacent scan lines performs a pre-charging process while another of the two adjacent scan lines does not perform a pre-charging process.

2. The display drive method of claim 1, comprising the following operations:

in a determination that the scan signal is at the first on-level, charging the pixel by the data signal;

wherein, an absolute value of the first on-level is greater than or equal to an absolute value of the second on-level.

3. The display drive method of claim 2, wherein, in one frame, the pre-charging duration of the pixel is equivalent to a charging duration of the pixel.

4. The display drive method of claim 1, wherein, in one frame, after the pixel is pre-charged, a number of times the data signal is inverted from the second polarity to the first polarity is at most one.

5. The display drive method of claim 1, wherein the first polarity is opposite to the second-polarity.

6. The display drive method of claim 5, wherein the first polarity is a positive polarity, and the second polarity is a negative polarity.

7. The display drive method of claim 5, wherein the first polarity is a negative polarity, and the second polarity is a positive polarity.

8. The display drive method of claim 1, wherein the first on-level and the second on-level are both high, and the off-level is low.

9. A display drive method, comprising the following operations:

in response to a scan signal on a scan line connected to a pixel being converted from an off-level to a first on-level at a first time point, in a determination that a data signal on a data line connected to the pixel is inverted from a first polarity to a second polarity, controlling the scan signal to be at a second on-level in a pre-charging duration before the first time point to pre-charge the pixel by the data signal, wherein the data signal is in the second polarity in the pre-charging duration, and an absolute value of the first on-level is greater than or equal to an absolute value of the second on-level; and in one frame, in response to the scan signal on the scan line connected to the pixel being converted from the off-level to the first on-level at a second time point, in a determination that a polarity of the data signal on the data line connected to the pixel does not change, controlling the scan signal to be at the off-level before the second time point;

wherein in one frame, a polarity inversion period of the data signal is twice a duration of the scan signal at the first on-level; and the scan signal on every other scan line has the second on-level, and one of two adjacent scan lines performs a pre-charging process while another of the two adjacent scan lines does not perform a pre-charging process.

10. A display device, comprising:

a display panel, comprising a plurality of pixels arranged in an array, a plurality of scan lines and a plurality of data lines; and a display drive component, connected to the plurality of scan lines and the plurality of data lines, in response to a scan signal on a scan line connected to a pixel being converted from an off-level to a first on-level at a first time point, in a determination that a data signal on a data line connected to the pixel is inverted from a first polarity to a second polarity, controlling, by the display drive component, the scan signal to be at a second on-level in a pre-charging duration before the first time point to pre-charge the pixel by the data signal, wherein the data signal is in the second polarity in the pre-charging duration;

wherein in one frame, in response to the scan signal on the scan line connected to the pixel being converted from the off-level to the first on-level at a second time point, in a determination that a polarity of the data signal on the data line connected to the pixel does not change, controlling, by the display drive component, the scan signal to be at the off-level before the second time point;

wherein in one frame, a polarity inversion period of the data signal is twice a duration of the scan signal at the first on-level; and the scan signal on every other scan line has the second on-level, and one of two adjacent scan lines performs a pre-charging process while another of the two adjacent scan lines does not perform a pre-charging process.

11. The display device of claim 10, wherein pixels located in a same row are connected to a same scan line, and pixels located in different rows are connected to different scan lines;

pixels located in a same column are connected to a same data line, and pixels located in different columns are connected to different data lines; and in one frame, a polarity inversion period of the data signal is twice a duration of the scan signal at the first on-level.

12. The display device of claim 10, wherein pixels located in a same row are connected to a same scan line, and pixels located in different rows are connected to different scan lines;

pixels located in a same column are connected to a same data line, and pixels located in different columns are connected to different data lines; and in one frame, a polarity inversion period of the data signal is twice a duration of the scan signal at the first on-level.

13. The display device of claim 10, wherein, in one frame, after the pixel is pre-charged, a number of times the data signal is inverted from the second polarity to the first polarity is at most one.

* * * * *